US005601422A

United States Patent [19]

Treiber et al.

[11] Patent Number: 5,601,422

[45] Date of Patent: Feb. 11, 1997

[54] ASSEMBLY FOR FEEDING FUEL OUT OF A SUPPLY TANK TO AN INTERNAL COMBUSTION ENGINE

[75] Inventors: Juergen Treiber, Bamberg; Hartmuth Kraemer, Ditzingen; Thomas Wuensch, Ludwigsburg; Stefan Woerz, Schwieberdingen; Willi Strohl, Beilstein, all of Germany

[73] Assignee: Robert Bosch GmbH, Stuttgart, Germany

[21] Appl. No.: 545,147

[22] Filed: Oct. 19, 1995

[30] Foreign Application Priority Data

Oct. 19, 1994 [DE] Germany ..... 44 37 377.5

[51] Int. Cl.[6] ..... F04C 2/344; F04C 13/00; F04C 15/00

[52] U.S. Cl. ..... 418/15; 418/184; 418/225

[58] Field of Search ..... 418/15, 184, 185, 418/225, 189

[56] References Cited

U.S. PATENT DOCUMENTS 345,885 7/1886 Colebrook ..... 418/225

2,737,121 3/1956 Badalini ..... 418/225

5,378,111 1/1995 Christopher ..... 418/225

FOREIGN PATENT DOCUMENTS 2835457 3/1980 Germany .

*Primary Examiner*—John J. Vrablik

*Attorney, Agent, or Firm*—Edwin E. Greigg; Ronald E. Greigg

[57] ABSTRACT

A fuel feed assembly with a feed pump of the roller-cell pump type, of which the pump rotor rotates eccentrically in a pumping chamber has a plurality of rollers which are guided in radial grooves of the disk-shaped pump rotor and are distributed uniformly over the circumference. When the pump rotor is rotating, the rollers run, as a result of the centrifugal force, on a bore wall of an intermediate ring radially delimiting the pumping chamber. The bore wall forms a running track. At the same time, the rollers delimit individual sickle-shaped pump rotor and the bore wall and the volume decreases from a suction port towards a delivery port as a result of the eccentricity of the pump rotor. At the same time, there is provided between the delivery port and suction port in the direction of rotation of the pump rotor a narrow-gap region which, according to the invention, is made so large that the pump working spaces passing through this region are closed completely.

4 Claims, 2 Drawing Sheets

ASSEMBLY FOR FEEDING FUEL OUT OF A SUPPLY TANK TO AN INTERNAL COMBUSTION ENGINE

PRIOR ART

The invention is directed to an assembly for feeding fuel out of a supply tank to an internal combustion engine. In such a feed assembly known from German Patent Specification 2,835,457, a drive motor drives in rotation, within a pump chamber, a pump rotor, designed as a grooved disk, of a feed pump of the roller-cell pump type. The pump chamber is delimited in the axial direction by a baseplate and a cover plate and in the radial direction by the wall of a bore of an intermediate ring clamped between the baseplate and cover plate. The inner delimitation of the pump chamber is obtained by means of the circumferential surface of the pump rotor, which is arranged in the pump chamber in such a way that its axis of rotation is eccentric to the axis of the bore wall of the intermediate ring, thereby resulting in a peripheral sickle-shaped pump working space which is divided, by the rollers guided in the individual radial grooves of the pump rotor and bearing on the wall of the bore of the intermediate ring during the operation of the pump as a result of the centrifugal force, into a plurality of pump working spaces which, during rotation, pass alternately over a suction port in the baseplate and a delivery port in the cover plate.

At the same time, after emergence from overlap with the suction port, the pressure of the fuel which has flowed into the respective pump working space by way of the suction port is increased as a result of the reduction in volume of the pump working space caused by the eccentricity of the pump rotor during its rotation in the pump chamber refuel flows off into the delivery port after the latter has been opened, and is guided further by way of a delivery conduit to the internal combustion engine to be supplied. Formed between the end of the delivery port and the start of the suction port is a narrow-gap region between the eccentrically mounted pump rotor and the intermediate-ring wall acting as a running surface, in which narrow-gap region the pump working spaces have their smallest volume during rotation. This narrow-gap region is to prevent an overflow of fuel from the delivery side to the suction side, which has an adverse influence on the efficiency of the pump, and therefore has to be made very small, although this results in a high production outlay in terms of the accuracy of the components. Moreover, the disadvantage of the feed pump of the known fuel feed assembly is that the pump working spaces passing through the narrow gap emerge from overlap with the delivery port only at a moment at which they have already traveled over the suction port with their other end, this resulting in very stringent requirements as regards the sealing-off of the narrow gap.

ADVANTAGES OF THE INVENTION

In contrast to this, the advantage of the fuel feed assembly according to the invention, is that the region of the narrow gap between the end of the delivery port and the start of the suction port is designed in such a way that the pump working spaces passing through this narrow gap travel over the suction port only when they have emerged completely from overlap with the delivery port (positive overlap). At the same time, the sealing effect on the narrow gap is assisted in that now at least one roller is always located in the narrow gap, and the sealing effect in the narrow-gap region can be increased considerably as a result of said roller bearing on the wall of the bore of the intermediate ring, without the production outlay in terms of accuracy being increased thereby.

At the same time, by the variation in the control times for the start of feed and end of feed, that is to say by the change in the position of the delivery and suction ports, the narrow gap is advantageously to be designed in such a way that, during the transition from the delivery region into the suction region, the individual dual working spaces are separated from the delivery and suction ports over an angle of rotation of approximately imately 20°.

A further advantageous consequence of the changed control times is that the change over time of the volume of the pump working spaces at the moment of emergence from overlap with the delivery port and at the moment of the start of overlap with the suction port is virtually zero, this resulting in a minimization of the pulsation of the fuel and thus in a reduction in the noise emission.

A further possibility for the design of the feed assembly according to the invention, particularly when it is used within a supply tank, is to arrange in the narrow gap a degassing bore which starts from the suction space and through which gas bubbles located there can be discharged, this in a known way having an advantageous effect on the flow conditions in the feed pump, particularly with heated fuel.

Further advantages and advantageous embodiments of the subject of the invention can be taken from the description, the drawing and the patent claims.

BRIEF DESCRIPTION OF THE INVENTION

An exemplary embodiment of the fuel feed assembly according to the invention is explained in more detail in the following description and is illustrated in the drawing in which:

FIG. 1 shows a section through the feed assembly with a drive motor and a feed pump, and FIG. 2 shows a representation of the feed pump from FIG. 1.

DESCRIPTION OF THE EXEMPLARY EMBODIMENT

Figure 1:
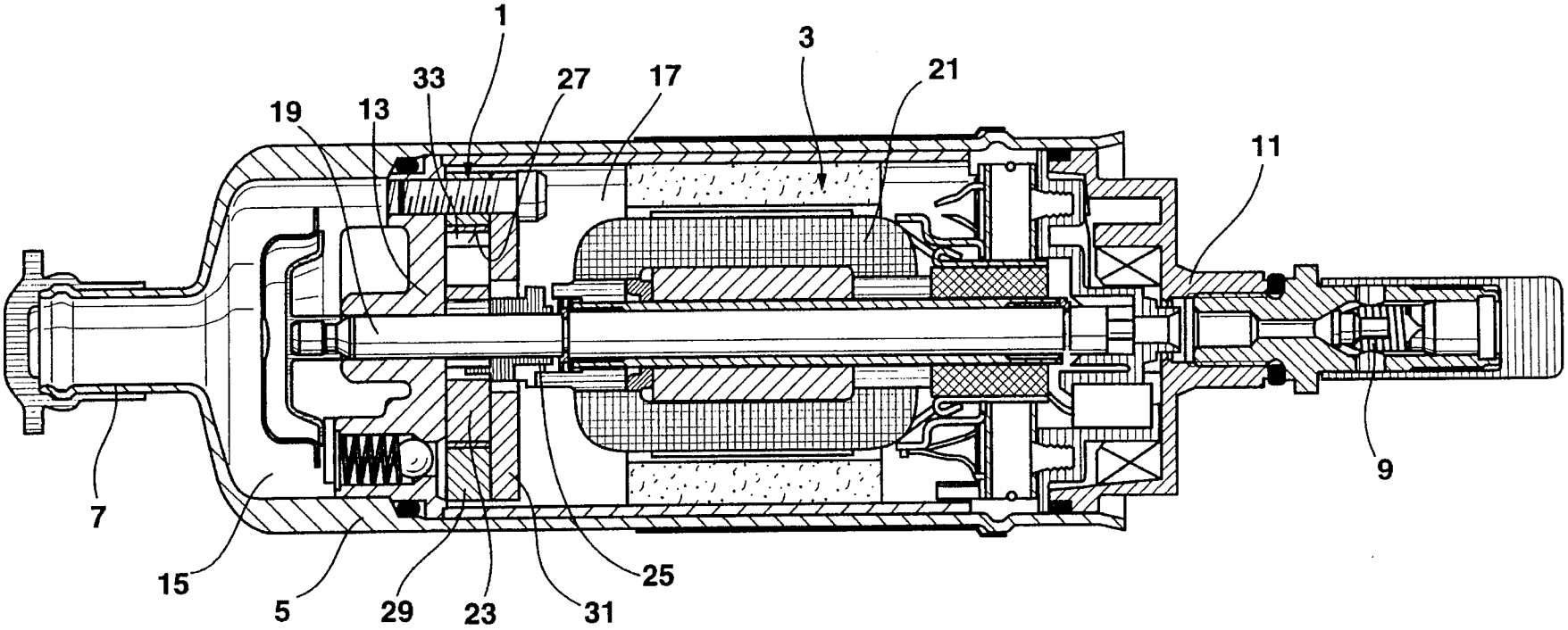

In the fuel feed assembly illustrated in FIG. 1, a feed pump i with an electric drive motor 3 driving the latter in rotation is inserted into a common housing 5. This housing 5 has, at one end, a suction connection 7 opening into a fuel supply tank (not shown) and, at its other end, a delivery connection 11 which contains a delivery valve 9 and to which a feed conduit (likewise not shown in more detail) to an internal combustion engine is connected.

The feed pump 1 designed as a roller-cell pump is supported by means of a baseplate 13 in the housing 5 and divides the latter into a suction space 15 adjoining the suction connection 7 and a delivery space 17 leading to the delivery connection 11, the drive motor 3 being arranged in the delivery space 17 and having a fuel throughflow.

Fastened in the baseplate 13 is a shaft 19, on which both an armature 21 of the drive motor 3 and a disk-shaped pump rotor 23 of the feed pump 1 are mounted rotatably, the armature 21 and the pump rotor 23 being connected to one another via a coupling part 25. As can be taken from FIG. 2, the disk-shaped pump rotor 23 rotates eccentrically in a bore 27 of an intermediate ring 29 which is covered, on one side, by the end wall, of the baseplate 13, confronting it and, on its other side, by a cover plate or support plate 31. At the same time, the end wall of the baseplate 13, the wall of the bore 27 of the intermediate ring 29 and the end wall of the cover plate 31 delimit a cylindrical pumping chamber 33, in which the eccentrically mounted pump rotor 23 rotates and which can be connected to the suction space 15 by way of a kidney-shaped suction port 35 (shown in more detail in FIG. 2) arranged level with the wall of the bore 27 of the intermediate ring 29 and located in the baseplate 13, and to the delivery space 17 by way of a delivery port 37 lying radially within the pump rotor 23 and located in the cover plate 31.

Figure 2:
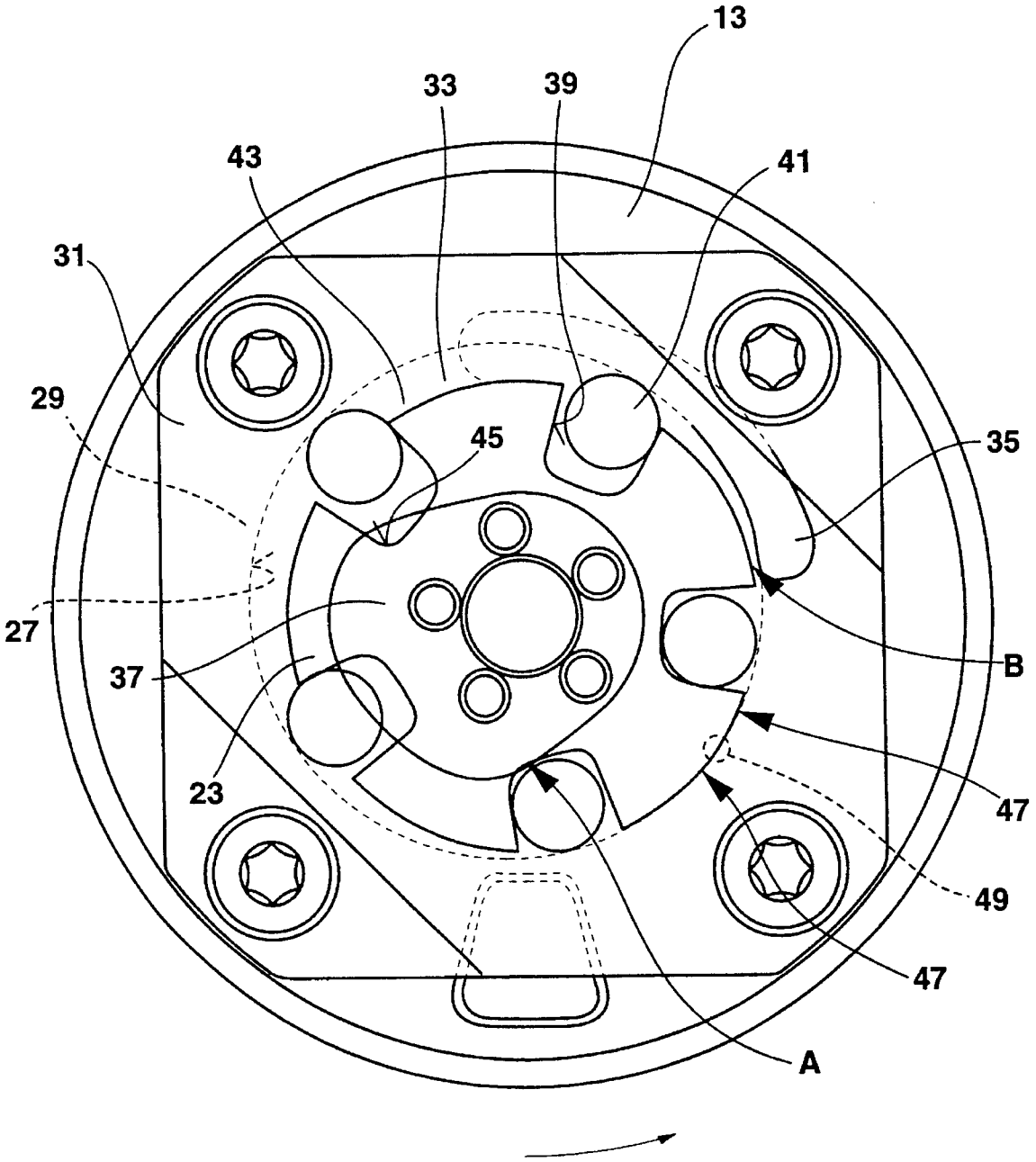

As is shown in FIG. 2, the pump rotor 23 has five radial grooves 39 which are arranged uniformly on its circumference, run radially inwards and in which displacement bodies in the form of rollers 41 are displaceably guided in each case. When the pump rotor 23 is rotating, these rollers 41 are pressed outward by the centrifugal force, so that they are pressed firmly against the wall of the bore 27 of the intermediate ring 29, said wall forming a running track, and, as a result of the rotation, run on said wall. Sickle-shaped pump working spaces 43 are obtained between the circumferential surface of the pump rotor 23 and the wall of the bore 27 and are delimited from one another by the individual rollers 41, and, during rotation together with the pump rotor 23, their volume decreases from the suction port 35 in the direction of rotation towards the delivery port 37.

At the same time, between the kidney-shaped suction port 35 and radially inner cam-shaped delivery port 37, in the direction of rotation of the pump rotor, there is provided between the circumferential surface of the pump rotor 23 and the wall of the bore 27 a working region, during the passage through which the volume of the respective pump working spaces 43 decreases continuously as a result of the eccentric arrangement of the pump rotor 23, so that, in addition to an acceleration of the fuel located in the pump working spaces 43, there is also an increase in pressure of said fuel, so that, when the pump working spaces 43 travel over the delivery port 37, the fuel enclosed in the pump working spaces 43 flows off by way of said delivery port into the delivery space 17. The opening of the connection of the pump working spaces 43 to the delivery port 37 takes place by means of the edges 45, located at the front in the direction of rotation, on the groove bottom of the radial grooves 39, the space underneath the rollers 41 being connected to the respective pump working space 43 by way of a residual play between the rollers 41 and the radial grooves 39.

Between the end of the delivery port 37, that is to say the moment of emergence of the pump working spaces 43 from overlap with the delivery port 37 (end of feed-A), and the start of the suction port 35, that is to say the moment of the start of the overlap of the respective pump working space 43 with the suction port 35 (start of suction-B), as a result of the eccentricity of the pump rotor 23, there is formed between its circumferential surface and the wall of the bore 27 a narrow-gap region 47, via which the delivery port 37 is sealed off relative to the suction port 35.

This narrow-gap region is dimensioned in such a way that, when they pass through it, the pump working spaces 43 open the suction port 35 only when they have emerged completely from overlap with the delivery port 37. This guarantees that a roller 41 is always located in the narrow-gap region and additionally seals off the delivery side and suction side relative to one another.

Moreover, the narrow-gap region 47 is designed in such a way that the individual pump working spaces 43, when they pass through it (from A to B), are completely uncoupled from the delivery and suction regions over an angle of rotation of approximately 20°.

Furthermore, the design of the narrow gap 47 makes it possible for the change over time of the volume of the respective pump working spaces 43 during passage through points A and B to be virtually zero, so that pulsations of the fuel then enclosed in the pump working space 43 or released can be avoided.

Moreover, for a discharge of gas bubbles out of the narrow-gap region 47, a degassing bore 49 opening into the suction space 15 is provided in the baseplate 13 in the region of the narrow gap 47.

The feed assembly according to the invention works as follows.

When current flows through the electric drive motor 3, its armature 21 is set into a rotational movement, which is transmitted to the pump rotor 23 via the coupling part 25. At the same time, fuel flows out of the suction space 15 by way of the suction port 35 into the respective pump working space 43 overlapping the suction port 35. This filling operation is further enhanced by the enlargement of the pump working spaces 43 in the suction region as a result of the eccentric mounting of the pump rotor 23, causing fuel to be sucked in. In the further course of the rotational movement of the pump rotor 23, the pump working spaces 43 emerge from their overlap with the suction port 35, in order shortly thereafter already to come into overlap with the delivery port 37, during the rotational movement of the pump rotor 23 the volume of the pump working spaces 43 decreasing continuously during their passage through the delivery region, so that the pressure of the fuel in the working spaces 43 rises. With the opening of the delivery port 37, the fuel then passes at increased pressure into the delivery space 17, flows through this along the drive motor 3 as far as the delivery connection 11 and further into the feed conduit to the internal combustion engine.

At the same time, the volume of the pump working spaces 43 decreases, up to the end of overlap with the delivery port 37, to a minimum value which then increases again at the start of the travel over the suction port 35.

By means of the feed assembly according to the invention, it is possible to increase the efficiency of the feed pump 1 by means of a constructionally simple and reliable sealing-off between the delivery side and the suction side as a result of varied control geometries and to reduce the noise emission of the feed pump.

The foregoing relates to preferred exemplary embodiments of the invention, it being understood that other variants and embodiments thereof are possible within the spirit and scope of the invention, the latter being defined by the appended claims.

We claim:

1. An assembly for feeding fuel out of a supply tank to an internal combustion engine, comprising a housing, a pumping chamber (33) in said housing, a roller cell type feed pump (1) which is driven in rotation by an electric drive motor (3), said feed pump includes a disk-shaped feed pump rotor (23) which is rotated in said pumping chamber (33) by said electric motor (3), said chamber (33) is delimited by a baseplate (13), by a wall of a bore (27) of an intermediate ring (29) and by a cover plate (31), the disk-shaped pump rotor (23) is mounted eccentrically relative to the bore (27) of the intermediate ring (29) and has a plurality of rollers (41) each guided by said pump rotor (23) in a radial groove (39), the rollers (41) are pressed, as a result of a centrifugal force, against the wall of the bore (27) of the intermediate ring (29) by rotation of the pump rotor (23), said wall acting as a running track, and, at the same time said wall delimits a pump working space (43) in the pumping chamber (33) between two adjacent rollers (41), a suction port (35) is located in the baseplate (13) and arranged in a region of the rotating pump working spaces (43), a delivery port (37) located in the cover plate (31) and a narrow-gap region (47) arranged between the delivery port (37) and said suction port (35) in the direction of rotation of the pump rotor (23) and located between the wall of the bore (27) of the intermediate ring (29) and the circumferential surface of the pump rotor (23), wherein the respective pump working space (43), when the pump rotor passes through the narrow-gap region (47), opens the suction port (35) only after complete emergence from overlap with the delivery port (37), and a degassing bore (49) is provided in the baseplate (13) in a region of the narrow-gap region.

2. The assembly as claimed in claim 1, wherein the extent of the narrow-gap region (47) is designed in such a way that at least one roller (41) of the pump rotor (23) is located in the narrow gap region at any point in time.

3. The assembly as claimed in claim 1, wherein during a transition from a delivery region into a suction region, the individual pump working spaces (43), when said working spaces pass through the narrow-gap region (47), are separated completely from the delivery port (37) and the suction port (35) over an angle of rotation of approximately 20°.

4. The assembly as claimed in claim 1, wherein the narrow-gap region (47) is designed in such a way that a change over time of the volume of the pump working spaces (43) passing through this narrow-gap region at the moment of emergence (A) from overlap with the delivery port (37) and at the moment of opening (B) of the suction port (35) is virtually zero.

* * * * *